United States Patent [19]

Obhayashi et al.

[11] Patent Number: 4,784,938

[45] Date of Patent: Nov. 15, 1988

[54] SILVER HALIDE PHOTOGRAPHIC LIGHT-SENSITIVE MATERIAL

[75] Inventors: Keiji Obhayashi; Shinichi Nakamura; Shigeo Tanaka; Mitsuhiro Okumura, all of Hino; Masanobu Miyoshi, Odawara; Makoto Kajiwara, Odawara; Kaoru Onodera, Odawara; Eiichi Sakamoto, Hino, all of Japan

[73] Assignee: Konishiroku Photo Industry Co., Ltd., Tokyo, Japan

[21] Appl. No.: 920,243

[22] Filed: Oct. 17, 1986

[30] Foreign Application Priority Data

Oct. 22, 1985 [JP] Japan ..... 60-236213
Jul. 31, 1986 [JP] Japan ..... 61-180975

[51] Int. Cl.[4] ..... G03C 1/40

[52] U.S. Cl. ..... 430/505; 430/551; 430/611; 430/219

[58] Field of Search ..... 430/611, 219, 551, 505

[56] References Cited

U.S. PATENT DOCUMENTS

| | | | |
|---|---|---|---|
| 3,600,178 | 8/1971 | Willems et al. | 430/611 |
| 4,264,721 | 4/1981 | Shimano et al. | 430/551 |
| 4,328,302 | 5/1982 | Nishimura et al. | 430/611 |
| 4,448,878 | 5/1984 | Yamamuro et al. | 430/551 |
| 4,451,555 | 5/1984 | Pollet et al. | 430/611 |

*Primary Examiner*—Won H. Louie
*Attorney, Agent, or Firm*—Jordan B. Bierman

[57] ABSTRACT

A silver halide photographic light-sensitive material which is improved on fog without decreasing photosensitivity. The photographic material comprises a support and a photographic structural layer provided thereon containing at least one silver halide emulsion layer and at least one non-light-sensitive layer. A nitrogen-containing heterocyclic mercapto compound is contained at least two layers of the photographic structure layer, and at least one of these mercapto compound-containing layer is a non-light-sensitive layer.

7 Claims, No Drawings

SILVER HALIDE PHOTOGRAPHIC LIGHT-SENSITIVE MATERIAL

FIELD OF THE INVENTION

The present ivnention relates to a silver halide photographic light-sensitive material (hereinafter called photosensitive material) containing at least one silver halide emulsion layer, and in particular, to a silver halide photosensitive material which features considerably minimized fogging without decreasing the sensitivity of the silver halide emulsion layer.

BACKGROUND OF THE INVENTION

Various anti-fogging agents are widely used in order to prevent fogging in silver halide photosensitive materials. As anti-fogging agents, heterocyclic compounds are preferably used as described, for example, in "Fundamentals of Photographic Technology—Silver Salt Photography—, pages 194–198 (The Photographic Society of Japan, 1979)". As the most effective heterocyclic compound, similar compounds containing a mercapto group are available. By adding such compounds which work as an anti-fogging agent to a photosensitive material, the fogging caused during storage or developing process of the photosensitive material may be satisfactorily minimized.

Yet, even if such an effective anti-fogging agent is added into a silver halide emulsion, the sensitivity of the emulsion often decreases. Consequently, the more effectively the fogging is suppressed, the more seriously and disadvantageously the sensitivity decreases.

Japanese Patent Publication Open to Public Inspection (hereinafter referred to as Japanese Patent O.P.I. Publication) No.36130/1976 disclosed a proposal, which was intended to solve such a sensitivity-fogging dilemma, whereby a silver halide emulsion essentially consisting of cubic crystals and silver halide content thereof containing more than 80 mol % silver chloride or silver bromide is sensitized with sulfer wherein a mercapto compound, having a pKa value not exceeding 7.6 and containing at least two nitrogen atoms, is added into the emulsion.

Yet, such requirements greatly limit the scope of composition of a silver halide emulsion, limiting the field of application of a photosensitive material based on such a prior art. Additionally, the experimental results learned by the inventor of the present invention, and other persons, revealed that the effect of the above-mentioned mercapto compound is lost, because of standing, before a silver halide emulsion, in which a like compound is added after chemically ripening the emulsion, is coated on a support, decreasing sensitivity, and that when the emulsion is cooled to set after the mercapto compound is added, the sensitivity also decreases, and that the scope of conditions where the silver halide photosensitive material is employed are strictly limited.

Additionally, in the case of certain effective mercapto compounds, even if an effective mercapto compound is added into a coating solution ready for coating prepared by cooling and setting a chemically ripened silver halide emulsion and by warming and melting it, in order to prevent the deterioration of sensitivity during the cooling and setting of such a silver halide emulsion, a like emulsion loses sensitivity when it is allowed to stand, thus limiting the scope of its application.

On the other hand, Japanese Patent O.P.I. Publication No. 164734/1982, No. 79436/1980 and No. 18327/1974, for example, disclosed that a mercapto compound may be added into a nonphotosensitive layer which does not contain a silver halide emulsion. However, with every example disclosed by the specifications mentioned above, a mercapto compound is added only into a silver halide emulsion layer, and, additionally, some of the specifications state that a similar compound should be preferably contained in the silver halide emulsion layer.

Further, Japanese Patent O.P.I. Publication No. 102621/1973 disclosed that a specific mercapto compound may be added to an arbitrarily designated photographic structural layer. However, though the specification disclosed examples where a specific mercapto compound is respectively added into a protective layer and a silver halide emulsion layer, and, of which effect is centered upon, like the examples mentioned before, the anti-fogging effect as well as anti-desensitization effect, the specification totally failed to state the features and benefits for a case where a mercapto compound is added into a non-photosensitive layer, or, the merits for the case where a mercapto compound is added into a plurality of nonphotosensitive layers of a silver halide photosensitive material.

Incidentally, if a photosensitive material is, as seen with a multi-layered color photographic material, composed on a plurality of silver halide emulsion layers, the antifogging and desensitization effects of a mercapto compound added to specific emulsion layers often cause the desensitization and anti-fogging effects not only in layers where the mercapto compound is added, but in other silver halide emulsion layers.

SUMMARY OF THE INVENTION

Therefore, it is an object of the present invention to provide a silver halide photosensitive material which is free from desensitization while a coating solution of emulsion is allowed to stand or an emulsion is cooled and set solidified , after the chemical ripening, but before being employed as a coating. It is also an object of the present invention to provide a similar photosensitive material which features considerably minimized fog occuring during the storage period after the application of coating solution as well as during the developing process.

The above-mentioned object of the present invention was achieved by a silver halide photographic light-sensitive material comprising a support and a photographic structural layer comprising at least one silver halide emulsion layer and at least one non-light-sensitive layer in which at least two layers of the photographic structural layer contain a nitrogencontaining heterocyclic mercapto compound and at least one of the layers containing the mercapto compound is a non-lightsensitive layer.

DETAILED DESCRIPTION OF THE INVENTION

As preferable heterocyclic rings having nitrogen atoms and being contained in heterocyclic mercapto compounds having nitrogen atoms employed in the present invention, the following are available:

imidaline ring, imidazole ring, imidazolone ring, pyrazoline ring, pyrazole ring, pyrazolone ring, oxazoline ring, oxazole ring, oxazolone ring, thiazoline ring, thiazole ring, thiazolone ring, selenazoline ring, selenazole ring, selenazolone ring, oxadiazole ring, thiadiazole ring, triazole ring, tetrazole ring, benzimidazole ring, benztriazole ring, indazole ring, benzoxazole ring, benzthiazole ring, benzselenazole ring, pyrazine ring, pyrimidine ring, pyridazine ring, triazine ring, oxazine ring, thiazine ring, tetrazine ring, quinazoline ring, phthalazine ring, polyazaindene rings (for example, triazaindene ring, tetrazaindene ring and pentazaindene ring). Additionally, as preferable nitrogen-containing heterocyclic mercapto compounds, the following examples, expressed by the general formula [1], below, are available: mercaptoxadiazole, mercaptothiadiazole and mercaptotriazole. Among these examples, mercaptordiazole is most preferred.

General formula [1]

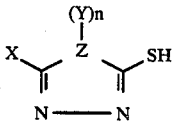

In the formula above, X represents a hydrogen atom, amino group, hydroxyl group, hydrazino group, alkyl group, alkenyl group, cycloalkyl group, aryl group, —$NHCOR_1$ group, —$NHSO_2$ R1 group or —$SR_2$ group. Y represents a hydrogen atom, amino group, alkyl group, alkenyl group, cycloalkyl group, aryl group, —$CONHR_3$ group, —$COR_4$ group, —$NHCOR_5$ group or —$NHSO_2S_5$ group. Z represents a nitrogen atom, sulfur atom or oxygen atom. n indicates 1 in case of a nitrogen atom, or, denotes 0 if Z represents an oxygen atom or a sulfur atom. $R_1$, $R_2$, $R_3$, $R_4$ and $R_5$ represent any one of an alkyl group, alkenyl group, cycloalkyl group or aryl group. As an alkyl group, which is represented by X or Y, one having 1–18 carbon atoms is preferred. For such an alkyl group such as this, a methyl group, ethyl group, propyl group, butyl group, octyl group, benzyl group and others are available. As a cycloalkyl group, a cyclohexyl group, cyclopentyl group and others should be noted. Additionally, as for an alkenyl group, one having 2–18 carbon atoms, such as an allyl group or octenyl group, is preferred. As for an aryl group, a phenyl group and naphthyl group are available. As an alkyl group, represented by $R_1$, $R_2$, $R_3$, $R_4$ or $R_5$, one containing 1–18 carbon atoms and having a straight-chain or branched-chain structure is preferred. For this example, a methyl group, ethyl group, propyl group, butyl, hexyl group and others are available. A cyclopentyl group and cyclohexyl group are preferred possibilities as cycloalkyl group. For an alkenyl group, like groups having 2–18 carbon atoms, for example, an allyl group, octenyl group, octadecenyl group are preferred. As a phenyl group, naphthyl group and others are preferred are preferred possibilities as an aryl group.

An alkyl group, cycloalkyl group, alkenyl group and aryl group represented by X, Y, $R_1$, $R_2$, $R_3$, $R_4$ and $R_5$ may contain a substituent. As exampels of a substituent, an alkyl group, cycloalkyl group, aryl group, alkenyl group, halogen atom, nitro group, cyano group, mercapto group, amino group, carboxylic group and hydroxyl group should be noted.

Additionally, the compound expressed by the general formula [1] according to the present invention shows the following tautomerism. The present invention also involves such a tautomer.

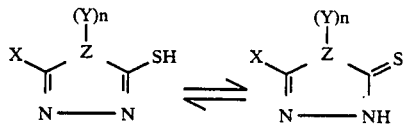

The followinq are the example compounds expressed by the formula [I].

I-1

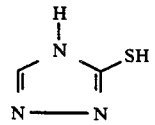

I-2

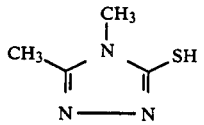

I-3

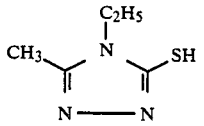

I-4

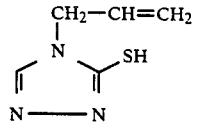

I-5

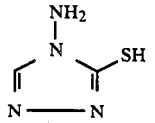

I-6

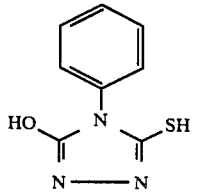

I-7

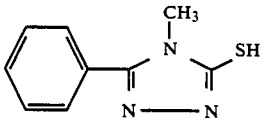

I-8

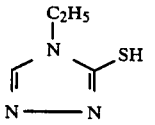

I-9

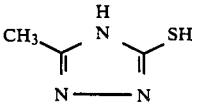

I-10

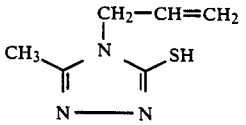

-continued
I-11
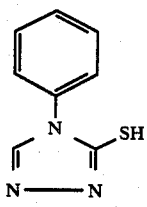
I-12
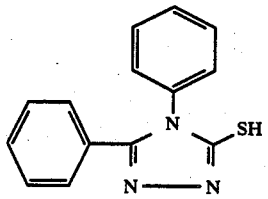
I-13
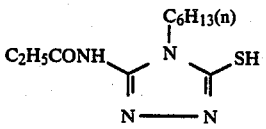
I-14
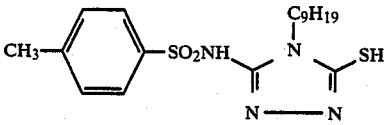
I-15
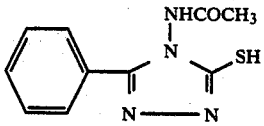
I-16
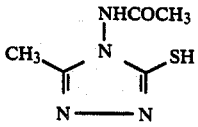
I-17
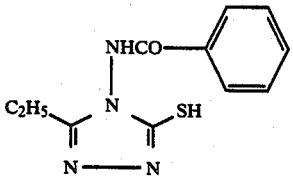
I-18
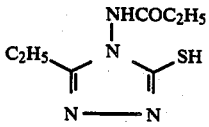
I-19
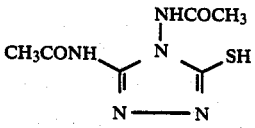
I-20
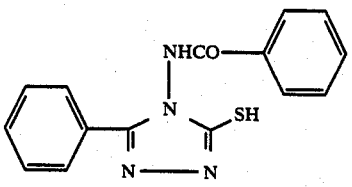
-continued
I-21
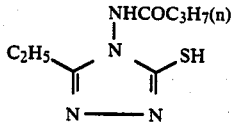
I-22
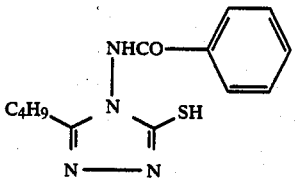
I-23
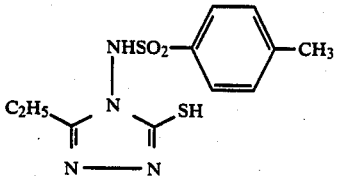
I-24
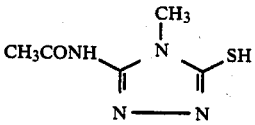
I-25
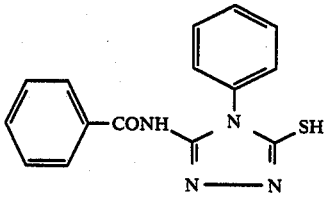
I-26
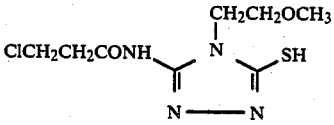
I-27
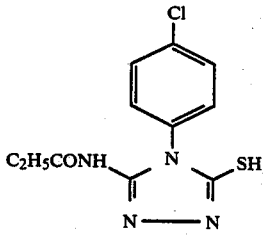
I-28
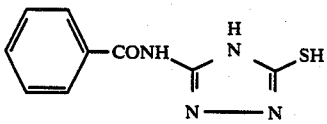
I-29
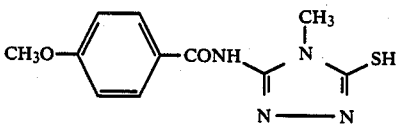

-continued
I-30
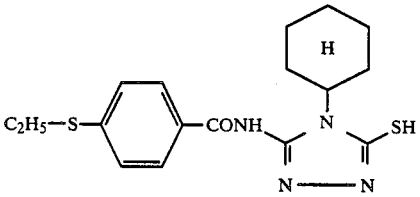
I-31
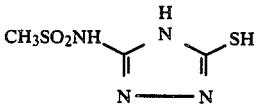
I-32
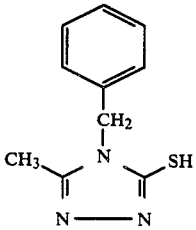
I-33
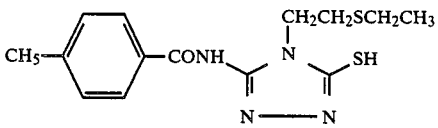
I-34
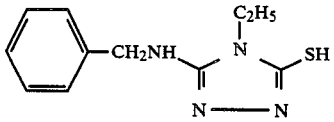
I-35
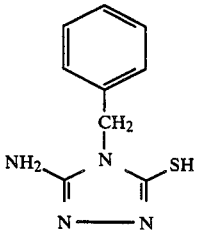
I-36
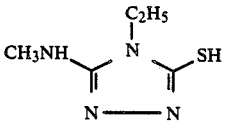
I-37
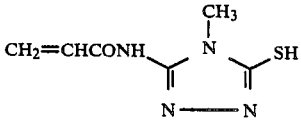
I-38
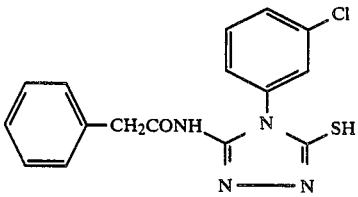
-continued
I-39
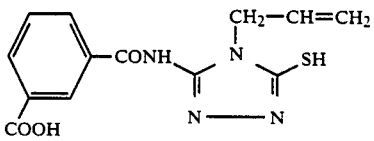
I-40
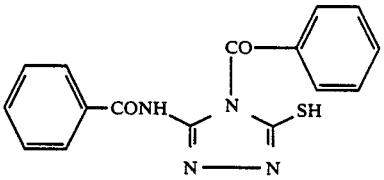
I-41
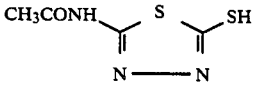
I-42
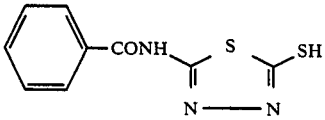
I-43
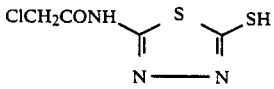
I-44
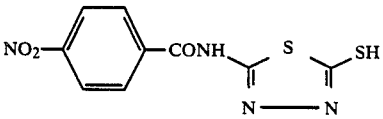
I-45
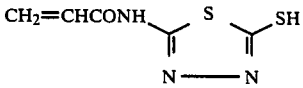
I-46
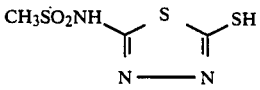
I-47
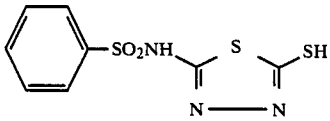
I-48
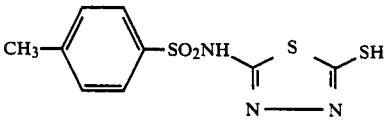
I-49
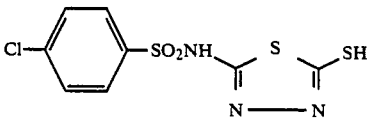
I-50
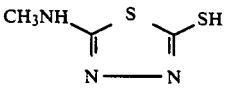

-continued
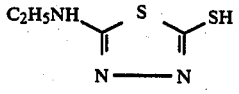
I-51
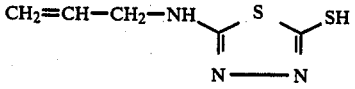
I-52
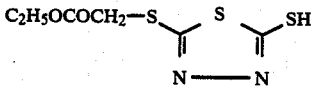
I-53
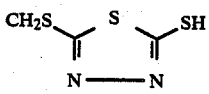
I-54
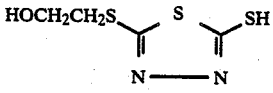
I-55
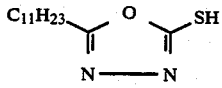
I-56
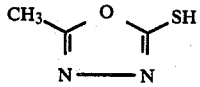
I-57
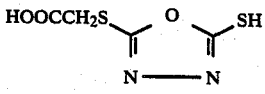
I-58
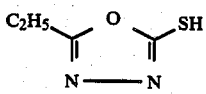
I-59
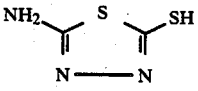
I-60
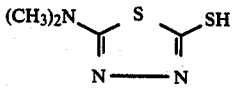
I-61
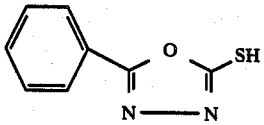
I-62
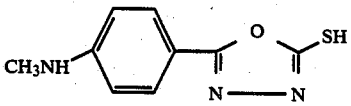
I-63
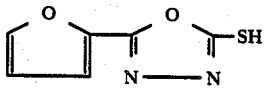
I-64
As examples of morcapto compounds other than the compounds expressed by general formula [I], according to the present invention, the following can be noted:
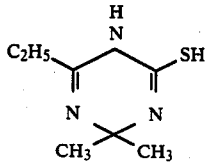
II-1
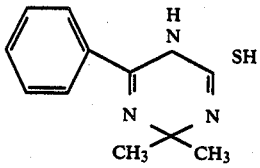
II-2
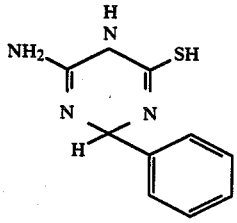
II-3
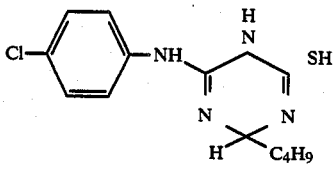
II-4
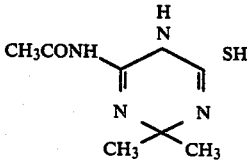
II-5
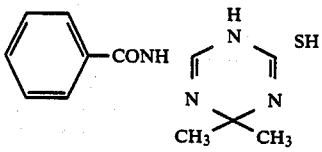
II-6
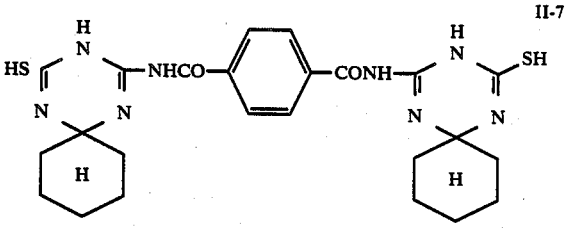
II-7
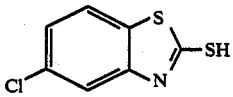
II-8
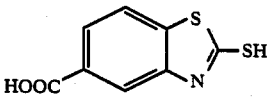
II-9

-continued

II-10

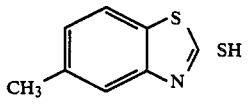

II-11

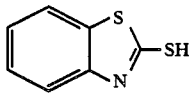

II-12

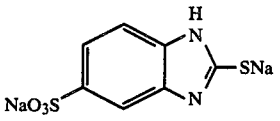

II-13

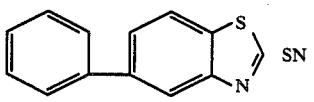

II-14

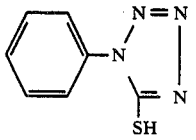

II-15

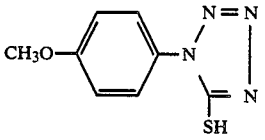

II-16

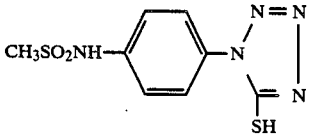

II-17

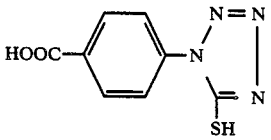

II-18

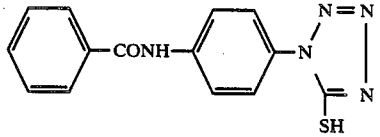

II-19

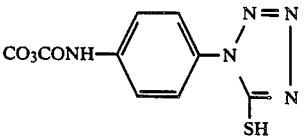

II-20

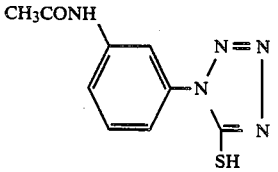

-continued

II-21

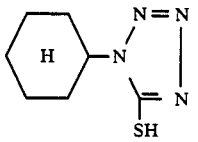

The above-mentioned compounds can be synthesized by referring to the following literatures:

Journal of Chemical Society 49, 1748, 1927; Journal of Organic Chemistry 39, 2469, 1965; Japanese Patent O.P.I. Publication No. 89034/1975, 79436/1980, 102639/1976 or 59463/1980; Annalen Chemie 44-3, 1954; Japanese Patent Publication No. 28496/1965; Chemical Berichte 20, 231, 1877; U.S. Pat. No. 3,259,976; Chemical and Pharmaceutical Bulletin vol.26,314, 1978, Tokyo; Berichte der Deutschen Gesellsdraft 82, 121, 1948; U.S. Pat. No. 2,834,491 or 3,017270; BP 940,169 or Journal of American Chemical Society 44, 1502-1510.

According to the present invention, a mercapto compound must be added into at least two photographic structural layers, and, at least one of these layers must be a non-photosensitive layer. Such non-photosensitive layers include intermediate layers, a subbing layer, a protective layer and other layers, and should be preferably a non-photosensitive layer adjacent to a silver halide photosensitive emulsion layer.

Other than the non-photosensitive layers, a mercapto compound is added into more than one structural layer. Such layers are arbitrarily selected from a silver halide photosensitive emulsion layer, intermediate layer, protective layer and other layers.

As for a layer which should be provided with a mercapto compound, a non-photosensitive layer exerting effect on a silver halide photosensitive emulsion layer where the fog should be most effectively suppressed is principally designated. Not less than 30 mol%, or preferably, not less than 50 mol % of the mercapto compound employed is added into the non-photosensitive layer and the remainder of the compound is distributed within other structural layers. Such a remainder should be preferably added into a non-photosensitive layer which exerts influence on a silver halide photosensitive emulsion layer which is provided with an anti-fogging feature by the incorporation of a mercapto compound. Additionally, a little amount, if any, of a mercapto compound remainder should be added into an emulsion layer where a great desensitization effect by a mercapto compound is expected, or into an emulsion layer adjacent to another emulsion layer where even a least desensitization effect is undersirable.

A mercapto compound may be added into a silver halide photosensitive emulsion layer. However, as a larger amount of such compound added may cause a desensitization disproportionate to a fog suppression effect, not more than 50 mol %, or more preferably, not more than 30 mol % of the compound should be added into the silver halide photosensitive emulsion layer.

More than one mercapto compound maybe used in an arbitrarily determined combination. Additionally, more than two mercapto compounds may be contained within one specific layer, or, they may be respectively contained in different layers.

The total addition of the mercapto compound greatly varies in accordance with a composition of layers of silver halide photosensitive materials, types of mercapto compounds, amount of silver halides or conditions where silver halide photosensitive materials are processed, and is generally within the range of $10^{-8}$ mol $10^{-4}$ mol/m$^2$, and more preferably, $10^{-7}$–$10^{-5}$ mol/m$^2$. However, the present invention does not specify the total addition, but it defines the amount of mercapto compounds in accordance with the degree of antifogging effect of mercapto compounds within every emulsion layer or between the several layers.

The present invention provides great degree of antifogging effect especially for a multi-layered color photographic material containing silver halide emulsion layers comprising at least one blue-sensitive layer, green-sensitive layer and red-sensitive layer, and more particularly, for a color photographic paper where a developing speed greatly differs layer by layer and a generation of even a slight fog may cause problems.

Generally in a color photographic paper, a blue-sensitive emulsion layer, first intermediate layer, green-sensitive emulsion layer, second intermediate layer, red-sensitive emulsion layer and protective layer are sequentially disposed upon a support. Every layer may be composed of more than two layers. In the latter case, if the blue-sensitive layer is provided with an anti-fogging effect by adding a mercapto compound, it is desirable to add the mercapto compound primarily into, for example, the first intermediate layer (preferably not less than 30 mol %), and to add the remainder into the blue sensitive emulsion layer and other layers. Additionally, if exerting an effect by a mercapto compound specifically on the red-sensitive emulsion layer, the required amount (for example, not less than 70 mol %) of a similar compound is added into the protective layer, and, the remainder is added into the second intermediate layer and/or the red sensitive emulsion layer. Consequently, this arrangement enables the prevention of a fog in the red-sensitive layer without seriously decreasing the sensitivity of the green-sensitive and red-sensitive layers. Further, if the effect of a mercapto compound is intended to exert upon only the red-sensitive and green-sensitive emulsion layers, the greater amount (preferably not less than 50 mol %) of the similar compound is specifically added into the second intermediate layer, and, the remainder is distributed into the red-sensitive and green-sensitive layers and/or the protective layer in proper proportions, in order to attain the object of the present invention.

For silver halides contained in a photosensitive emulsion layer comprising the silver halide photosensitive material according to the present invention, silver halides such as silver bromide, silver iodo-bromide, silver iodo-chloride, silver chloro-bromide, silver chloro-iodo-bromide and silver chloride are normally and arbitrarily employed.

A silver halide emulsion according to the present invention may be chemically sensitized by a conventional process. More specifically, a sulfer sensitization, selenium sensitization, reduction sensitization, noble metal sensitization involving gold and other noble metals are available methods, and one or several of such processes may be arbitrarily employed.

A silver halide emulsion according to the present invention may be optically sensitized in regard to a required wave range by using a sensitizing dye known inthe photographic art.

With a photosensitive material according to the present invention, a known anti-fogging agent, other than a mercapto compound according to the present invention, or a compound known as a stabilizer, may be added into arbitrarily designated photographic structural layers during and after the chemical ripening of a silver halide emulsion and/or before the similar emulsion is coated on a support, in order to prevent fogging while a photosensitive material is prepared and stored, or, while the material is photographically processed, or, in order to maintain a stable photographic performance of the material.

With a multi-layered color photographic light-sensitive material according to the present invention, emulsion layers of the photosensitive material contain a color-forming coupler which is allowed to couple, during the color developing process, with an oxidized product of a primary aromatic amine developing agent (for example, a derivative of p-phenylenediamine, or a derivative of aminophenol), forming a color.

As for a yellow color-forming coupler, known acylacetanilide couplers may be preferably used. Among such examples, a benzoylacetanilide coupler and pivaloylacetanilide are favorable.

As for a magenta color-forming coupler, know 5-pyrazolone coupler, pyrazolonebenzimidazole coupler, pyrasolonetriazole coupler, closed-chain acylacetonitrile coupler may be preferably used.

As for a cyan color-forming coupler, known naphthol coupler and phenol coupler may be preferably used.

For a developing process involving a photosensitive material according to the present invention, every known process may be employed.

As for color developing processing, a color developing process, bleaching process, fixing process, and, if so required, rinsing process and/or stabilization process are exercised. Additionally, instead of processes involving bleaching solution and fixing solution, a monobath bleach-fixing solution may be used so as to accomplish bleaching and fixing processes, or, a monobath processes utilizing a monobath developing-fixing solution may be employed in order to complete color developing, bleaching, and fixing within a single bath.

EXAMPLES

EXAMPLE-1

Polyethylene was coated upon the one side of a 170 g/m$^2$ paper support, wherein polyethylene containing 11 weight % of anatase titanium dioxide was disposed upon the other side thereof in order to prepare a laminated support, wherein the following layers were sequentially superposed upon the side which had polyethylene coating containing tiranium dioxide, so as to prepare the silver halide color photographic light sensitive materials No. 1–14. Additionally, an amount added is, if not otherwise specified, expressed by the amount per one square meter.

Layer 1 . . . A layer containing 1.2 g gelatin and 0.32 g (silver equivalent, and, hereinafter applicable) blue-sensitive silver bromide emulison (Note - 1; AgBr 90 mol %; average grain size, 0.50 $\mu$m), and additionally, 0.70 g yellow coupler (Y - 1) and 0.04 g anti-stain agent HQ - 1 dissolved in 0.50 g di-2-ethylhexylphthalate (hereinafter referred to as DOP).

Layer 2 . . . An intermediate layer containing 0.7 g gelatin and 15 mg anti-irradiation dye (AI - 1), 10 mg (AI - 2) and 0.05 g HQ - 1 dissolved in 0.05 g DOP.

Layer 3 . . . A layer containing 1.25 g gelatine, and additionally, 0.22 g green-sensitive silver chloro-bromide agent (Note - 2; AgBr 60 mol %; average grain size, 0.40 μm), 0.45 g magenta coupler (M - 1) and 0.01 g HQ - 1 dissolved in 0.30 g DOP.

Layer 4 . . . An intermediate layer containing 1.2 g gelatin, and, 0.08 g HQ - 1 as well as 0.5 g ultraviolet ray absorbing agent (UV - 1) dissolved in 0.35 g DOP.

Layer 5 . . . A layer containing 1.4 g gelatin and 0.20 g red-sensitive silver chloro-bromide emulsion (Note - 3; AgBr 60 mol %; average grain size, 0.65 μm),and additionally, 0.25 g cyan coupler (C - 1), 0.25 g cyan coupler (C - 2) and 0.01 g HQ - 1 dissolved in 0.20 g DOP.

Layer 6 . . . A layer containing 1.0 g gelatin, and, 0.30 g UV - 1 dissolved in 0.20 g DOP.

Layer 7 . . . A layer containing 0.5 g gelatin.

Additionally, 0.04 g 2,4-dichloro-6-hydrozy-s-triazinesodium which serves as a hardening agent was added respectively into layers 4 and 7, mentioned above, immediately before the coating each corresponding emulsion.

Y-1

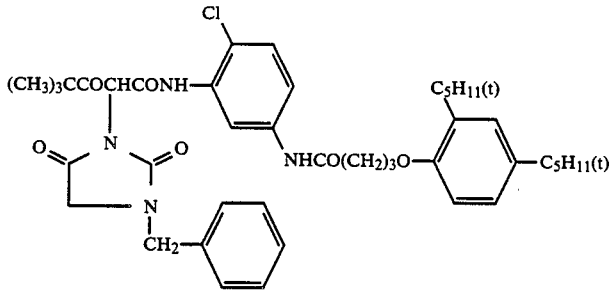

M-1

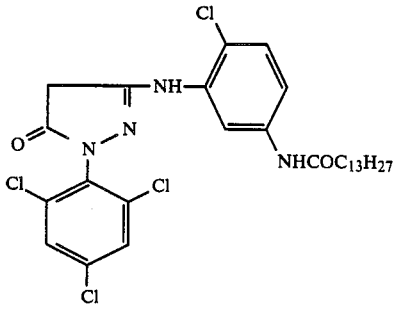

HQ-1

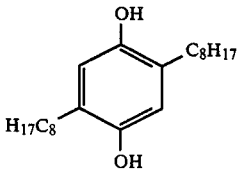

UV-1

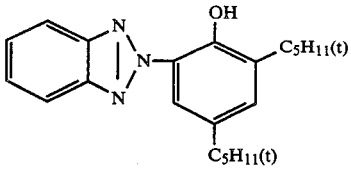

C-1

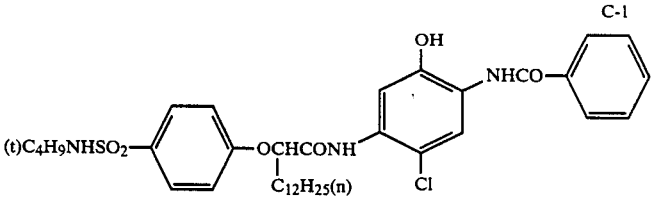

C-2

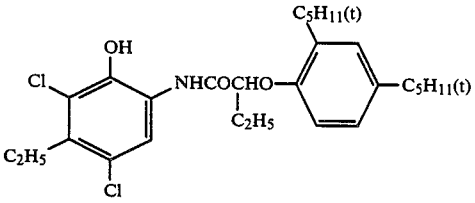

AI-1

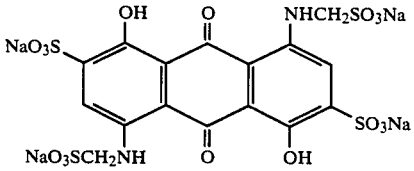

AI-2

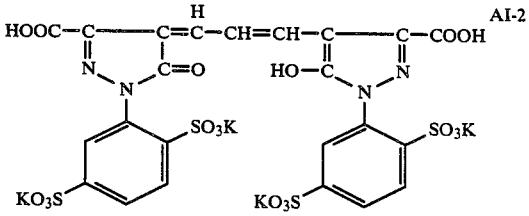

(Note-1) Blue-sensitive silver chloro-bromide emulsion $2.8\times10^{-5}$ mol sodium thiosulfate per mol of silver halide, was added so as to provide chemical sensitization, wherein optical sensitization was exercised by employing a blue-sensitizing dye. As a stabilization agent, $4.5\times10^{-3}$ mol 4-hydroxy-6-methyl-1,3,3a,7-tetrazaindene per mol of silver halide was further added.

(Note-2) Green-sensitive silver chloro-bromide emulsion $3.5\times10^{-5}$ mol sodium thiosulfate per mol of silver halide was added so as to provide chemical sensitization, wherein optical sensitization was exercised by employing a green-sensitizing dye. As a stablization agent, $4.5\times10^{-3}$ mol 4-hydroxy-6-methyl-1,3,3a,7-tetrazaindene per mol of silver halide was further added.

(Note-3) Red-sensitive silver chloro-bromide emulsion $3.5\times10^{-3}$ mol sodium thiosulfate per mol of silver halide was added so as to provide chemical sensitization, wherein optical sensitization was exercised by employing a red-sensitizing dye. As a stabilization agent, $4.5\times10^{-3}$ mol 4-hydroxy-6-methyl-1,3,3a,7-tetrazaindene per mol of silver halide was further added.

For every sample, the exemplified mercapto compound I - 24 was added into each coating solution.

Additionally, coating was exercised in two levels, after each coating solution was blended; one where a coating solution was allowed to stand for one hour at 42° C. before it was used, and the other, where a coating solution was let to stand for eight hours before it was used.

Each sample of the above-mentioned photosensitive materials was exposed with a white light through an optical wedge, then, treated with the following processes.

| Treatment (38° C.) | |
|---|---|
| Color developing | 2 min 30 sec |
| Bleaching-fixing | 1 min |
| Rinsing | 1 min |
| Drying | 2 min at 60–80° C. |

The contents of each processing solution are as follows.

| [Color developing solution] | |
|---|---|
| Pure water | 800 ml |
| Benzyl alcohol | 15 ml |
| Triethanolamine | 10 g |
| Hydrozyamine sulfate | 2.0 g |
| Potassium bromide | 1.5 g |
| Sodium chloride | 1.0 g |
| Potassium sulfite | 2.0 g |
| N—ethyl-N—β-methane- | 4.5 g |

-continued

| [Color developing solution] | |
|---|---|
| sulfonamidethyl-3-methyl-4-amino-aniline sulfate | |
| 1-hydroxyethylidene-1,1-diphosphonic acid (60% aqueous solution) | 1.5 ml |
| Potassium carbonate | 32 g |
| Whitex BB (50% aqueous solution) (fluorescent brightener, manufactured by Sumitomo Chemical Co., Ltd.) | 2 ml |

Pure water was added to the materials above, to prepare a 1 l solution, wherein 20% potassium hydroxide solution or 10% dilute sulfuric acid was added so as to provide a solution with a pH value of 10.1.

| [Bleach-fixing solution] | |
|---|---|
| Pure water | 600 ml |
| Ferric (III) ammonium ethylenediaminetetraacetate | 65 g |
| Di-sodium ethylenediaminetetraacetate | 20 g |
| Ammonium thiosulfate | 85 g |
| Sodium hydrogenesulfite | 10 g |
| Sodium metabisulfite | 2 g |
| Sodium bromide | 10 g |
| Color developing solution A | 200 ml |

Pure water was added to the materials, above, so as to prepare 1 l solution, wherein a dilute sulfuric acid was added to provide the solution with the pH value 7.0.

For every sample obtained, the reflecting density was measured respectively with three monochromatic lights, blue, green and red, and, the sensitivity and fogging properties of each sample were determined by referring to a characteristic curve generated from the measurement, mentioned above. The results are shown in Table-1.

B, G and R in the table mean that a neutral coloring area was measured for the density respectively with monochromatic lights, blue, green and red. The sensitivity in the table is a relative sensitivity expressed by assuming the sensitivity of sample 1 is 100.

TABLE 1

| Sample No. | Mercapto compound Layer 1 | Layer 2 | Layer 3 | Layer 4 | Layer 5 | Layer 6 | Layer 7 | Sensitivity B $1^H$ | B $8^H$ | G $1^H$ | G $8^H$ | R $1^H$ | R $8^H$ | Fog B $1^H$ | B $8^H$ | G $1^H$ | G $8^H$ | R $1^H$ | R $8^H$ |
|---|---|---|---|---|---|---|---|---|---|---|---|---|---|---|---|---|---|---|---|
| 1 | — | — | — | — | — | — | — | 100 | 92 | 100 | 96 | 100 | 94 | 0.08 | 0.11 | 0.08 | 0.10 | 0.04 | 0.06 |
| 2 | 0.08 mg | — | — | — | — | — | — | 86 | 72 | 94 | 92 | 99 | 94 | 0.05 | 0.05 | 0.08 | 0.09 | 0.04 | 0.06 |
| 3 | — | — | 0.08 mg | — | — | — | — | 96 | 90 | 73 | 62 | 90 | 88 | 0.07 | 0.11 | 0.04 | 0.04 | 0.04 | 0.05 |
| 4 | 0.04 mg | — | 0.04 mg | — | — | — | — | 90 | 79 | 78 | 66 | 96 | 90 | 0.06 | 0.07 | 0.05 | 0.07 | 0.04 | 0.06 |
| 5 | 0.08 mg | — | 0.08 mg | — | — | — | — | 80 | 69 | 65 | 53 | 90 | 87 | 0.04 | 0.05 | 0.04 | 0.04 | 0.04 | 0.06 |
| 6 | — | 0.08 mg | — | — | — | — | — | 91 | 88 | 90 | 86 | 98 | 92 | 0.05 | 0.06 | 0.07 | 0.09 | 0.04 | 0.06 |
| 7 | — | 0.12 mg | — | — | — | — | — | 89 | 84 | 82 | 79 | 98 | 91 | 0.05 | 0.06 | 0.06 | 0.08 | 0.04 | 0.06 |
| 8 | — | — | — | 0.08 mg | — | — | — | 96 | 90 | 89 | 86 | 86 | 82 | 0.08 | 0.12 | 0.06 | 0.08 | 0.03 | 0.04 |
| 9 | — | — | — | 0.12 mg | — | — | — | 96 | 89 | 80 | 76 | 80 | 75 | 0.08 | 0.11 | 0.05 | 0.07 | 0.03 | 0.03 |
| 10 | — | 0.10 mg | — | 0.02 mg | — | — | — | 91 | 88 | 84 | 81 | 98 | 93 | 0.05 | 0.06 | 0.05 | 0.06 | 0.03 | 0.03 |
| 11 | 0.02 mg | 0.10 mg | — | 0.02 mg | — | — | — | 89 | 85 | 84 | 82 | 99 | 93 | 0.04 | 0.04 | 0.05 | 0.06 | 0.03 | 0.04 |
| 12 | — | 0.10 mg | 0.02 mg | — | — | — | — | 92 | 87 | 82 | 80 | 99 | 92 | 0.05 | 0.06 | 0.04 | 0.05 | 0.04 | 0.05 |

TABLE 1-continued

| Sample No. | Mercapto compound Layer 1 | Layer 2 | Layer 3 | Layer 4 | Layer 5 | Layer 6 | Layer 7 | Sensitivity B $1^H$ | B $8^H$ | G $1^H$ | G $8^H$ | R $1^H$ | R $8^H$ | Fog B $1^H$ | B $8^H$ | G $1^H$ | G $8^H$ | R $1^H$ | R $8^H$ |
|---|---|---|---|---|---|---|---|---|---|---|---|---|---|---|---|---|---|---|---|
| 13 | — | 0.12 mg | 0.02 mg | 0.02 mg | — | — | — | 92 | 86 | 80 | 76 | 96 | 91 | 0.05 | 0.06 | 0.03 | 0.04 | 0.04 | 0.04 |
| 14 | 0.02 mg | 0.08 mg | — | 0.06 mg | — | — | — | 89 | 84 | 88 | 84 | 90 | 84 | 0.05 | 0.05 | 0.05 | 0.05 | 0.04 | 0.04 |

As indicated by the results in Table-1, when examining the results for samples 6–9 where the example mercapto compound I-24 was added only into the first or second intermediate layer, the samples 6 and 7 feature effectively suppressed yellow fogging at the price of minimized loss in blue-sensitivity, when compared to the results for the samples 2, 3, 4 and 5 in which the mercapto compound was added only into the blue-sensitive layer 1 or green-sensitive layer. However, the mercapto compound contained in the samples 6 and 7 seem less effective in suppressing a fogging phenomenon in the green-sensitive layer. Additionally, the sample containing the mercapto compound only in the layer 4 is more effective, when compared to a case where the compound was added only into the layer 2, in suppressing magenta fog. However, when such a sample can effectively suppress the magenta fog, at the same time it decreases the sensitivity of the red-sensitive layer.

On the contrary, with the samples 10–14 according to the present invention, a properly prescribed amount of the example mercapto compound was added into more than one layers arbitrarily selected from the first intermediate layer and the layer 2, and, the layers 1, 3 and 4, in order to provide each layer with preferable anti-fogging property while minimizing the loss of sensitivity of each layer.

EXAMPLE-2

By replacing a mercapto compound I-24 with I-40, an experiment was carried out in the same manner as in Example-1. The results are shown in Table-2. The values for sensitivity and fog were obtained by applying coating solutions which respectively were allowed to stand for eight hours at 42° C. after being blended.

As indicated by the results in Table-2, the samples 24–29 according to the present invention may, like samples in Example-1, effectively suppress fogging in every layer while minimizing the loss of sensitivity, by adding a proper amount of a mercapto compound into more than two layers which are arbitrarily designated.

TABLE 2

| Sample No. | Mercapto compound (I-40) Layer 1 | Layer 2 | Layer 3 | Layer 4 | Layer 5 | Layer 6 | Layer 7 | Sensitivity B | G | R | Fog B | G | R |
|---|---|---|---|---|---|---|---|---|---|---|---|---|---|
| 1 | — | — | — | — | — | — | — | 100 | 100 | 100 | 0.011 | 0.10 | 0.06 |
| 15 | 0.1 mg | — | — | — | — | — | — | 76 | 94 | 98 | 0.04 | 0.09 | 0.06 |
| 16 | — | — | 0.1 mg | — | — | — | — | 96 | 80 | 97 | 0.10 | 0.05 | 0.05 |
| 17 | 0.05 mg | — | 0.05 mg | — | — | — | — | 88 | 90 | 99 | 0.07 | 0.06 | 0.06 |
| 18 | 0.1 mg | — | 0.1 mg | — | — | — | — | 71 | 76 | 97 | 0.04 | 0.05 | 0.05 |
| 19 | — | 0.05 mg | — | — | — | — | — | 98 | 98 | 100 | 0.08 | 0.09 | 0.06 |
| 20 | — | 0.1 mg | — | — | — | — | — | 96 | 97 | 99 | 0.06 | 0.08 | 0.06 |
| 21 | — | 0.2 mg | — | — | — | — | — | 92 | 95 | 99 | 0.05 | 0.08 | 0.06 |
| 22 | — | — | — | 0.1 mg | — | — | — | 99 | 96 | 92 | 0.11 | 0.07 | 0.04 |
| 23 | — | — | — | 0.2 mg | — | — | — | 98 | 95 | 88 | 0.10 | 0.06 | 0.03 |
| 24 | — | 0.01 mg | — | 0.05 mg | 0.1 | — | — | 96 | 96 | 95 | 0.06 | 0.06 | 0.05 |
| 25 | — | 0.1 mg | — | 0.1 mg | — | — | — | 95 | 94 | 92 | 0.06 | 0.05 | 0.04 |
| 26 | 0.03 mg | 0.1 mg | — | 0.03 mg | — | — | — | 93 | 96 | 98 | 0.04 | 0.06 | 0.05 |
| 27 | 0.02 mg | 0.1 mg | 0.02 mg | — | — | — | — | 94 | 94 | 98 | 0.04 | 0.05 | 0.06 |
| 28 | 0.02 mg | 0.08 mg | 0.02 mg | 0.02 mg | — | — | — | 94 | 92 | 97 | 0.05 | 0.05 | 0.05 |
| 29 | — | 0.1 mg | 0.02 mg | 0.02 mg | — | — | — | 96 | 94 | 97 | 0.06 | 0.05 | 0.05 |

EXAMPLE-3

The experiment was carried out in the same manner as in Example-2, by employing both mercapto compounds I-40 and I-24. The layers where the compounds were added as well as the amounts added are shown in Table-3.

The results in Table-3 indicate that the same effect as Example-2 may be attained even if more than two of the example compounds according to the present invention are employed in combination.

TABLE 3

| Sample No. | Mercapto compound Layer 1 | Layer 2 | Layer 3 | Layer 4 | Layer 5 | Layer 6 | Layer 7 | Sensitivity B | G | R | Fog B | G | R |
|---|---|---|---|---|---|---|---|---|---|---|---|---|---|
| 1 | — | — | — | — | — | — | — | 100 | 100 | 100 | 0.11 | 0.10 | 0.06 |
| 30 | (I-24) 0.05 mg | — | — | — | — | — | — | 86 | 98 | 100 | 0.06 | 0.10 | 0.06 |
| 31 | (I-24) 0.10 mg | — | — | — | — | — | — | 72 | 96 | 99 | 0.05 | 0.09 | 0.06 |
| 32 | — | — | (I-40) 0.05 mg | — | — | — | — | 98 | 81 | 99 | 0.10 | 0.06 | 0.06 |
| 33 | — | — | (I-40) 0.10 mg | — | — | — | — | 97 | 74 | 98 | 0.09 | 0.04 | 0.05 |
| 34 | — | (I-24) 0.05 mg (I-24) 0.10 mg | — | — | — | — | — | 95 | 97 | 99 | 0.06 | 0.07 | 0.06 |
| 35 | (I-24) 0.02 mg | (I-24) 0.05 mg | (I-40) 0.02 mg | — | — | — | — | 93 | 94 | 98 | 0.05 | 0.05 | 0.06 |
| 36 | (I-24) 0.02 mg | (I-24) 0.05 mg | — | (I-40) 0.10 mg | — | — | — | 94 | 93 | 93 | 0.06 | 0.04 | 0.05 |
| 37 | — | (I-24) 0.10 mg | — | (I-40) 0.10 mg | — | — | — | 94 | 90 | 94 | 0.06 | 0.04 | 0.05 |

TABLE 3-continued

| Sample No. | Mercapto compound Layer 1 | Layer 2 | Layer 3 | Layer 4 | Layer 5 | Layer 6 | Layer 7 | Sensitivity B | G | R | Fog B | G | R |
|---|---|---|---|---|---|---|---|---|---|---|---|---|---|
| 38 | (I-24) 0.02 mg | (I-24) 0.10 mg | (I-40) 0.02 mg | (I-40) 0.10 mg | — | — | — | 92 | 89 | 93 | 0.05 | 0.03 | 0.05 |

EXAMPLE-4

The experiment was carried out by replacing the red-sensitive silver chloro-bromide emulsion contained in the layer 5 in Example-1 with an emulsion having 50 mol % AgBr with average grain size 0.4 μm, wherein the chemical sensitization and the optical sensitization were provided as mentioned in Example-1 and Example-3. Additionally, the exemplified mercapto compound I-24 was added as shown in Table-4.

The results in Table-4 indicate that the effect of the present invention may be attained even if a mercapto compound is added primarily into the layer 4 and if layers where a similar compound is added are arbitrarily selected from the layers 1, 2, 5 and 6.

TABLE 4

| Sample No. | Mercapto compound (I-24) Layer 1 | Layer 2 | Layer 3 | Layer 4 | Layer 5 | Layer 6 | Layer 7 | Sensitivity B | G | R | Fog B | G | R |
|---|---|---|---|---|---|---|---|---|---|---|---|---|---|
| 39 | — | — | — | — | — | — | — | 100 | 100 | 100 | 0.14 | 0.13 | 0.21 |
| 40 | 0.05 mg | — | 0.05 mg | — | 0.08 mg | — | — | 84 | 82 | 70 | 0.07 | 0.08 | 0.11 |
| 41 | 0.05 mg | — | 0.05 mg | — | 0.15 mg | — | — | 83 | 80 | 51 | 0.06 | 0.06 | 0.05 |
| 42 | 0.02 mg | — | 0.02 mg | 0.15 mg | — | 0.05 mg | — | 92 | 90 | 90 | 0.07 | 0.06 | 0.07 |
| 43 | — | 0.08 mg | — | 0.15 mg | — | 0.05 mg | — | 91 | 92 | 93 | 0.07 | 0.05 | 0.06 |
| 44 | 0.02 mg | 0.08 mg | — | 0.05 mg | — | 0.20 mg | — | 88 | 93 | 87 | 0.06 | 0.05 | 0.05 |
| 45 | 0.02 mg | — | — | 0.20 mg | 0.02 mg | 0.15 mg | — | 93 | 92 | 87 | 0.06 | 0.05 | 0.04 |
| 46 | 0.02 mg | — | — | 0.15 mg | 0.02 mg | 0.15 mg | — | 93 | 94 | 89 | 0.06 | 0.06 | 0.05 |

EXAMPLE-5

The following layers were sequentially superposed upon a paper support having a lamination of polyethylene so as to prepare the silver halide color photographic light sensitive materials No.47-68.

Layer 1 . . . A layer containing 1.4 g gelatin and 0.35 g blue-sensitive silver chloride emulsion (BEM; average grain size, 0.68 μm; after chemical sensitization was carried out with sodium thiosulfate and chloroauric acid, and blue-sensitization was exercised with blue-sensitizing dye, wherein a mercapto compound shown in Table-5 was added). This layer also contains 0.90 g yellow coupler (Y-2), 0.04 g HQ-1 and 0.03 g light stabilizer (STB-1) dissolved in 0.40 g dinonyl phthalate (hereinafter referred to as DNP).

Layer 2 . . . Same as the layer 2 in Example-1.

Layer 3 . . . A layer containing 1.3 g gelatin and 0.29 g green-sensitive silver chloride emulsion (GEM; average grain size, 0.42 μm; after chemical sensitization was carried out with sodium thiosulfate and chloroauric acid, and, green sensitization was exercised with green-sensitizing dye, wherein a mercapto compound shown in Table-5 was added). This layer also contains 0.45 g magenta coupler (M-2), 0.01 g HQ-1, 0.2 g light stabilizer (STB-2) and 0.08 g light stabilizer (STB-3) dissolved in 0.30 g DOP.

Layer 4 . . . Same as the layer 4 in Example-1.

Layer 5 . . . A layer containing 1.4 g gelatin and 0.26 g red-sensitive silver chloride emulsion (REM; average grain size, 0.42 μm; after chemical sensitization was exercised with sodium thiosulfate and chloroauric acid, wherein red-sensitization was exercised with red-sensitizing dye, wherein a mercapto compound shown in Table-5 was added). This layer also contains 0.23 g cyan coupler (C-3), 0.18 g cyan coupler (C-4), 0.01 g HQ-1 and 0.2 g STB-1 dissolved in 0.30 g DOP.

Layer 6 . . . Same as the layer 6 in Example-1.

Laeyr 7 . . . Same as the layer 7 in Example-1.

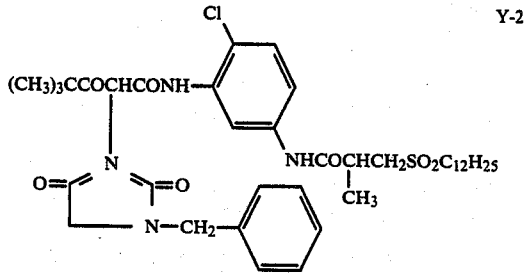

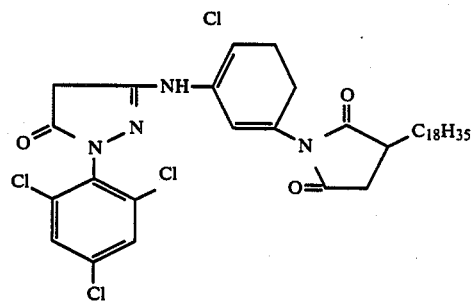

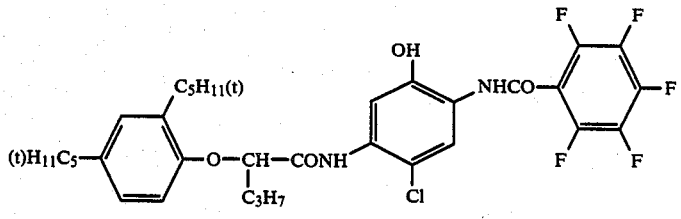

-continued

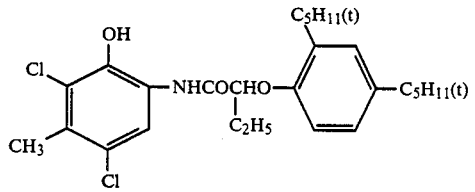

C-4

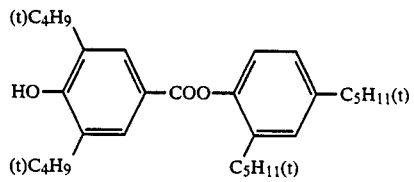

STB-1

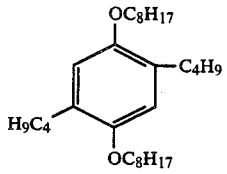

STB-2

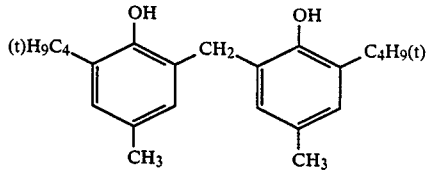

STB-3

TABLE 5

| | Marcapto compound | |
|---|---|---|
| BEM-1 | I-24 | 0.28 |
| BEM-2 | " | 0.68 |
| BEM-3 | I-62 | 0.28 |
| BEM-4 | II-14 | 0.28 |
| BEM-5 | II-15 | 0.28 |
| BEM-6 | II-21 | 0.28 |
| GEM-1 | I-24 | 0.56 |
| GEM-2 | " | 2.0 |
| GEM-3 | I-62 | 0.56 |
| GEM-4 | II-14 | 0.56 |
| GEM-5 | II-15 | 0.56 |
| GEM-6 | II-21 | 0.56 |
| REM-1 | I-24 | 0.68 |
| REM-2 | " | 2.40 |
| REM-3 | I-62 | 0.68 |
| REM-4 | II-14 | 0.68 |
| REM-5 | II-15 | 0.68 |
| REM-6 | II-21 | 0.68 |

The unit of an amount added is the millimol per mol of silver halide.

The silver halide emulsions in Table-5 were, after being blended, stored in a refrigerator for two weeks until they were employed for coating.

Additionally, immediately before each silver halide emulsion was employed for coating, a mercapto compound was added into the layers as shown in Table-5. Further, such an arrangement was performed in two levels; one where a coating solution was aged for one hour at 42° C. after being blended, and the other, where a coating solution was aged for eight hours.

The samples 47, 52, 56, 60 and 64 respectively have total mercapto compounds at the ratio of 4.0 micro mol/$m^2$. The other samples respectively contain the compounds at the ratio of 13.3 micro mol/$m^2$.

The prepared photosensitive materials, mentioned above, were exposed to white light through an optical wedge, and then, treated in accordance with the following processes.

| Treatment (35° C.) | |
|---|---|
| Color developing | 45 sec |
| Bleaching-fixing | 45 sec |
| Rinsing | 90 sec |
| Drying | 2 min at 60–80° C. |

The contents of each processing solution are as follows.

| [Color developing solution B] | |
|---|---|
| Pure water | 800 ml |
| Triethanolamine | 10 g |
| N,N—diethylhydroxylamine (85% aquenous solution) | 5 g |
| Potassium chloride | 2.8 g |
| Potassium sulfite | 0.2 g |
| Ethylenediaminetetraacetic acid | 1 g |
| N—ethyl-N—β-methane-sulfonamidethyl-3-methyl-4-amino-aniline sulfate | 5 g |
| 1-hydroxyethylidene-1,1-diphosphonic acid | 1 g |
| Potassium carbonate | 25 g |
| Whitex BB (50% aqueous solution) (fluorescent brightener, manufactured by Sumitomo Chemical Co., Ltd.) | 2 ml |

Pure water was added to the materials, above, to prepare a 1 l solution having the pH value of 10.2.

| [Bleaching-fixing solution] | |
|---|---|
| Pure water | 600 ml |
| Ferric (III) ammonium ethylenediaminetetraacetate | 65 g |
| Disodium ethylenediaminetetraacetate | 5 g |
| Ammonium thiosulfate | 85 g |
| Sodium hydrogenesulfite | 10 g |
| Sodium metabisulfite | 2 g |
| Potassium chloride | 10 g |
| Color developing solution B | 200 ml |

Pure water was added to the materials, above, so as to prepare a 1 l solution which has the pH value of 6.2.

The reflection density was measured on the samples obtained in the same manner as Example-1, and, the results shown in Table-6 were offered.

A sensitivity in the table is a relative sensitivity expressed by assuming the sensitivity of the sample 47, after the coating solution was allowed to stand for one hour, was 100.

The results in Table-6 indicate that the samples 47, 52, 56, 60 and 64 containing smaller amount of mercapto inhibiter in silver halide emulsion are, though having relatively high sensitivity, not provided with satisfactory anti-fogging effect.

At the same time, in the samples 48, 53, 57, 61 and 65 containing a larger amount of mercapto compound only in the silver halide emulsion layers 1, 3 and 5, only the fog is effectively suppressed, and, additionally, the development of fogging due to the standing of the coating solution is also effectively suppressed. However, the sensitivity is greatly decreased and worse, the standing of the coating solution further deteriorates such a desensitization.

TABLE 6

| Sample No. | Silver halide emulsion Layer 1 | Silver halide emulsion Layer 3 | Silver halide emulsion Layer 5 | Mercapto compound added into coating solution (micromol/m²) Layer 1 | Layer 2 | Layer 3 | Layer 4 | Layer 5 | Mol % of mercapot compound contained layers 2 and 4 |
|---|---|---|---|---|---|---|---|---|---|
| 47 (c) | BEM-1 | GEM-1 | REM-1 | — | — | — | — | — | 0 |
| 48 (c) | " | " | " | I-24 2.6 | — | I-24 4.1 | — | I-24 2.6 | 0 |
| 49 (p) | " | " | " | I-24 1.3 | I-24 1.0 | I-24 2.0 | I-24 3.7 | I-24 1.3 | 35 |
| 50 (p) | " | " | " | — | I-24 4.0 | — | I-24 5.1 | — | 70 |
| 51 (c) | BEM-2 | GEM-2 | REM-2 | — | — | — | — | — | 0 |
| 52 (c) | BEM-3 | GEM-3 | REM-3 | — | — | — | — | — | 0 |
| 53 (c) | " | " | " | I-62 2.6 | — | I-62 4.1 | — | I-62 2.6 | 0 |
| 54 (p) | " | " | " | I-62 1.3 | I-62 1.0 | I-62 2.0 | I-62 3.7 | I-62 1.3 | 35 |
| 55 (p) | " | " | " | — | I-62 4.2 | — | I-62 5.1 | — | 70 |
| 56 (c) | BEM-4 | GEM-4 | REM-4 | — | — | — | — | — | 0 |
| 57 (c) | " | " | " | II-14 2.6 | — | II-14 4.1 | — | II-14 2.6 | 0 |
| 58 (p) | " | " | " | II-14 1.3 | II-14 1.0 | II-14 2.0 | II-14 3.7 | II-14 1.3 | 35 |
| 59 (p) | " | " | " | — | II-14 4.2 | — | II-14 5.1 | — | 70 |
| 60 (c) | BEM-5 | GEM-5 | REM-5 | — | — | — | — | — | 0 |
| 61 (c) | " | " | " | II-15 2.6 | — | II-15 4.1 | — | II-15 2.6 | 0 |
| 62 (p) | " | " | " | II-15 1.3 | II-15 1.0 | II-15 2.0 | II-15 3.7 | II-15 1.3 | 35 |
| 63 (p) | " | " | " | — | II-15 4.2 | — | II-15 5.1 | — | 70 |
| 64 (c) | BEM-6 | GEM-6 | REM-6 | — | — | — | — | — | 0 |
| 65 (c) | " | " | " | II-21 2.6 | — | II-21 4.1 | — | II-21 2.6 | 0 |
| 66 (p) | " | " | " | II-21 1.3 | II-21 1.0 | II-21 2.0 | II-21 3.7 | II-21 1.3 | 35 |
| 67 (p) | " | " | " | — | II-21 4.2 | — | II-21 5.1 | — | 70 |
| 68 (p) | " | " | " | — | II-14 4.2 | — | II-14 5.1 | — | 35 |

| Sample No. | Sensitivity B $1^H$ | Sensitivity B $8^H$ | Sensitivity G $1^H$ | Sensitivity G $8^H$ | Sensitivity R $1^H$ | Sensitivity R $8^H$ | Fog B $1^H$ | Fog B $8^H$ | Fog G $1^H$ | Fog G $8^H$ | Fog R $1^H$ | Fog R $8^H$ |
|---|---|---|---|---|---|---|---|---|---|---|---|---|
| 47 (c) | 100 | 93 | 100 | 97 | 100 | 94 | 0.24 | 0.41 | 0.16 | 0.20 | 0.17 | 0.20 |
| 48 (c) | 83 | 65 | 80 | 66 | 72 | 51 | 0.07 | 0.08 | 0.07 | 0.07 | 0.06 | 0.05 |
| 49 (p) | 94 | 90 | 92 | 88 | 88 | 79 | 0.07 | 0.07 | 0.08 | 0.08 | 0.06 | 0.05 |
| 50 (p) | 96 | 89 | 94 | 92 | 90 | 86 | 0.07 | 0.08 | 0.08 | 0.07 | 0.05 | 0.06 |
| 51 (c) | 62 | 54 | 51 | 43 | 36 | 40 | 0.07 | 0.08 | 0.07 | 0.07 | 0.05 | 0.05 |
| 52 (c) | 126 | 124 | 108 | 96 | 124 | 120 | 0.27 | 0.36 | 0.14 | 0.19 | 0.15 | 0.21 |
| 53 (c) | 102 | 81 | 92 | 70 | 96 | 72 | 0.06 | 0.07 | 0.07 | 0.08 | 0.06 | 0.07 |
| 54 (p) | 110 | 100 | 100 | 89 | 110 | 96 | 0.07 | 0.07 | 0.07 | 0.07 | 0.05 | 0.07 |
| 55 (p) | 124 | 117 | 103 | 96 | 119 | 109 | 0.06 | 0.07 | 0.06 | 0.07 | 0.05 | 0.06 |
| 56 (c) | 89 | 80 | 104 | 100 | 96 | 89 | 0.31 | 0.37 | 0.19 | 0.22 | 0.16 | 0.18 |
| 57 (c) | 62 | 47 | 76 | 52 | 53 | 37 | 0.11 | 0.13 | 0.10 | 0.11 | 0.07 | 0.08 |
| 58 (p) | 80 | 72 | 89 | 77 | 78 | 60 | 0.10 | 0.14 | 0.09 | 0.11 | 0.08 | 0.08 |
| 59 (p) | 82 | 77 | 93 | 90 | 88 | 82 | 0.11 | 0.13 | 0.09 | 0.11 | 0.07 | 0.07 |
| 60 (c) | 118 | 101 | 106 | 93 | 123 | 121 | 0.17 | 0.19 | 0.10 | 0.13 | 0.11 | 0.15 |
| 61 (c) | 101 | 74 | 92 | 77 | 90 | 75 | 0.05 | 0.06 | 0.04 | 0.05 | 0.03 | 0.04 |
| 62 (p) | 113 | 100 | 96 | 89 | 99 | 89 | 0.04 | 0.06 | 0.04 | 0.05 | 0.03 | 0.04 |
| 63 (p) | 117 | 113 | 104 | 92 | 104 | 97 | 0.04 | 0.06 | 0.04 | 0.04 | 0.03 | 0.03 |
| 64 (c) | 102 | 90 | 114 | 107 | 106 | 90 | 0.21 | 0.29 | 0.20 | 0.26 | 0.24 | 0.27 |
| 65 (c) | 87 | 80 | 100 | 90 | 87 | 70 | 0.07 | 0.07 | 0.05 | 0.06 | 0.03 | 0.04 |
| 66 (p) | 96 | 90 | 109 | 99 | 93 | 87 | 0.05 | 0.05 | 0.05 | 0.05 | 0.02 | 0.04 |
| 67 (p) | 99 | 95 | 107 | 103 | 101 | 94 | 0.05 | 0.06 | 0.04 | 0.05 | 0.03 | 0.03 |
| 68 (p) | 107 | 104 | 107 | 105 | 105 | 101 | 0.05 | 0.05 | 0.04 | 0.05 | 0.03 | 0.04 |

(c) means a comparison sample.
(p) means a sample according to the present invention.

Contrary to such conventional samples, the present invention can provide satisfactory anti-fogging effect at the price of minimized desensitization.

Additionally, the results also indicate that the sample 51 where an enough amount of compound to suppress fogging was previously added into the silver halide emulsion accompanies serious desensitization.

EXAMPLE-6

Instead of BEM-6, GEM-6 and REM-6 contained in the samples 64-68 in embodiment-5, silver halide emulsions containing 0.2 g adenine, working as a stabilizer, per one mol silver halide emulsion were added into samples so as to perform the experiment in the same manner as in Example-5.

As shown in Table-7, the specified amounts of the mercapto compounds shown in the same table were added into the layers 1-5.

The samples obtained were treated in the same manner as in Example-5, and, the results in Table-7 were offered.

The results in Table-7 indicate that the sample 69 containing only adenine and no mercapto compounds within silver halide emulsion layers, though having the highest sensitivity, shows the great degree of fog. This fog is further increased by the standing of the coating solution.

At the same time, with the samples 70 and 71 containing mercapto compounds only in silver halide emulsion layers, the sensitivit is decreased by larger amount of the added mercapto compounds, though the fog may be satisfactorily suppressed, and additionally, the sensitivity further decreases due the standing of the coating solution. In addition, with the samples 72-74 having a mercapto compound only in a non-photosensitive layer 1, it is impossible to suppress the fog in every layer satisfactorily as well as to minimize the loss of sensitivity.

On the contrary, with the samples 75-79 according to the present invention, while comparatively high sensitivity being provided, and further, while the deterioration of sensitivity during the standing of the coating solution being minimized, the fogging phenomenon in all the three layers is effectively supppressed.

TABLE 7

| Sample No. | Mercapto compound added into coating solution (micromol/m²) Layer 1 | Layer 2 | Layer 3 | Layer 4 | Layer 5 | Layer 6 | Mol % of compound contained in layers 2, 4 and 6 |
|---|---|---|---|---|---|---|---|
| 69 (c) | — | — | — | — | — | — | — |
| 70 (c) | II-15 2.0 | — | II-15 2.0 | — | II-15 2.0 | — | 0 |
| 71 (c) | II-15 6.0 | — | II-15 4.0 | — | II-15 4.0 | — | 0 |
| 72 (c) | — | II-15 12 | — | — | — | — | 100 |
| 73 (c) | — | — | — | II-15 12 | — | — | 100 |
| 74 (c) | — | — | — | — | — | II-15 12 | 100 |
| 75 (p) | — | II-15 4 | — | II-15 8 | — | — | 100 |
| 76 (p) | | II-15 6 | — | II-15 6 | — | — | 100 |
| 77 (p) | | II-15 4 | — | II-15 4 | — | II-15 4 | 100 |
| 78 (p) | II-15 1.0 | II-15 2.0 | — | II-15 2 | II-15 2 | II-15 5 | 75 |
| 79 (p) | II-15 2.0 | II-15 2.0 | II-21 2.0 | II-15 2 | II-21 2 | II-21 2 | 50 |

| Sample No. | Sensitivity B $1^H$ | B $8^H$ | G $1^H$ | G $8^H$ | R $1^H$ | R $8^H$ | Fog B $1^H$ | B $8^H$ | G $1^H$ | G $8^H$ | R $1^H$ | R $8^H$ |
|---|---|---|---|---|---|---|---|---|---|---|---|---|
| 69 (c) | 100 | 90 | 100 | 94 | 100 | 92 | 0.32 | 0.49 | 0.35 | 0.46 | 0.21 | 0.27 |
| 70 (c) | 90 | 79 | 94 | 88 | 82 | 66 | 0.14 | 0.16 | 0.11 | 0.17 | 0.09 | 0.13 |
| 71 (c) | 82 | 61 | 87 | 74 | 54 | 43 | 0.07 | 0.08 | 0.06 | 0.06 | 0.04 | 0.05 |
| 72 (c) | 89 | 82 | 89 | 83 | 98 | 93 | 0.04 | 0.04 | 0.07 | 0.07 | 0.12 | 0.15 |
| 73 (c) | 96 | 88 | 92 | 85 | 89 | 87 | 0.13 | 0.17 | 0.07 | 0.07 | 0.03 | 0.03 |
| 74 (c) | 97 | 88 | 97 | 94 | 91 | 84 | 0.24 | 0.37 | 0.20 | 0.28 | 0.03 | 0.04 |
| 75 (p) | 94 | 88 | 96 | 90 | 92 | 84 | 0.07 | 0.08 | 0.06 | 0.06 | 0.03 | 0.03 |
| 76 (p) | 92 | 86 | 90 | 87 | 92 | 85 | 0.05 | 0.06 | 0.04 | 0.04 | 0.04 | 0.04 |
| 77 (p) | 96 | 87 | 95 | 91 | 91 | 86 | 0.07 | 0.09 | 0.06 | 0.07 | 0.02 | 0.02 |
| 78 (p) | 90 | 81 | 96 | 91 | 87 | 80 | 0.06 | 0.06 | 0.07 | 0.08 | 0.02 | 0.02 |
| 79 (p) | 88 | 74 | 91 | 80 | 88 | 82 | 0.07 | 0.07 | 0.07 | 0.07 | 0.04 | 0.04 |

(c) means a comparison sample.
(p) means a sample according to the present invention

EXAMPLE-7

Instead of adenine, 0.10 mol sodium chloride as well as 0.05 mol potassium bromide per one mol silver halide, working as stablizers, were added respectively into the blue-sensitive silver halide emulsion, green-sensitive silver halide emulsion and red-sensitive silver halide emulsion mentioned in Example-6, in order to prepare the silver halide color photographic light sensitive materials 80-90 in the same manner as in Example-6, then, the experiment was carried out in the same manner as in Example-6.

The results of such an experiment indicate that the samples according to the present invention can, like the samples according to the present invention and mentioned in Example-6, provide every emulsion layer with the anti-fogging effect, like the samples in which adenine was employed, at the price of minimized loss of sensitization in every layer as well as the minimized loss of sensitization while the emulsion is allowed to stand after being prepared.

What is claimed is:

1. A silver halide color photographic light-sensitive material comprising a reflective support having thereon a plurality of photographic structural layers including emulsion layers which comprise at least one blue-sensitive silver halide emulsion layer, at least one green-sensitive silver halide emulsion layer, at least one red-sensitive silver halide emulsion layer, and one non-light-sensitive layer adjacent to two of said emulsion layers, said emulsion layers containing dye-forming couplers, wherein;

said non-light-sensitive leyer and at least one other of said photographic structural layers include a nitrogen-containing heterocyclic mercapto antifogging compound.

2. The silver halide color photographic light-sensitive material of claim 1 wherein at least one of said other photographic structural layers is another non-light-sensitive layer.

3. The silver halide color photographic light-sensitive material of claim 1 wherein at least one of said other photographic structural layers is a silver halide emulsion layer.

4. The silver halide color photographic light-sensitive material of claim 2 wherein said other non-light-sensitive layer is adjacent to two emulsion layers.

5. The silver halide color photographic light-sensitive material of claim 4 wherein the total amount of said compound contained in said non-light-sensitive layers is at least 30 mole percent of the total amount of said compound contained in said plurality of photographic structural layers.

6. The silver halide color photographic light-sensitive material of claim 5 wherein the total amount of said compound contained in said non-light-sensitive layers is at least 50 mole percent of the total amount of said compound contained in said plurality of photographic structural layers.

7. The silver halide color photographic light-sensitive material of claim 1, wherein said nitrogen-containing heterocyclic mercapto compound is represented by General Formula [I]

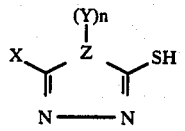

General formula [1]

wherein,

X is selected from the group consisting of a hydrogen atom, a hydroxy group, a hydrazino group, an alkyl group, an alkenyl grouop, a cycloalkyl group, an aryl group, —NHCOR$_1$ group, —NHSO$_2$R$_1$ group, and SR$_2$ group, Y is selected from the group consisting of a hydrogen atom, an amino group, an alkyl group, an alkenyl group, a cycloalkyl group, an aryl group, —CONHR$_3$ group, —COR$_4$ group, —NHCOR$_5$ group and —NHSO$_2$R$_5$ group, Z is selected from a nitrogen atom, a sulfur atom and an oxygen atom, when Z is a nitrogen atom n is 1, and when Z is an oxygen atom or a sulfur atom n is 0, R$_1$, R$_2$, R$_3$, R$_4$ and R$_5$ are independently selected from the group consisting of an alkyl group, an alkenyl group, a cycloalkyl goup and an aryl group.

* * * * *